US010087067B2

(12) United States Patent
Perdrix et al.

(10) Patent No.: US 10,087,067 B2
(45) Date of Patent: Oct. 2, 2018

(54) FLUID TRANSFER APPARATUS

(71) Applicant: HOULDER LIMITED, London (GB)

(72) Inventors: Frederic Vincent Perdrix, London (GB); Gianpaolo Benedetti, London (GB); Luiz Eduardo Demenicis, London (GB)

(73) Assignee: Houlder Limited, London (GB)

( * ) Notice: Subject to any disclaimer, the term of this patent is extended or adjusted under 35 U.S.C. 154(b) by 11 days.

(21) Appl. No.: 15/307,851

(22) PCT Filed: May 1, 2015

(86) PCT No.: PCT/GB2015/051305
§ 371 (c)(1),
(2) Date: Oct. 31, 2016

(87) PCT Pub. No.: WO2015/166287
PCT Pub. Date: Nov. 5, 2015

(65) Prior Publication Data

US 2017/0057806 A1 Mar. 2, 2017

(30) Foreign Application Priority Data

May 2, 2014 (GB) ..... 1407827.3

(51) Int. Cl.

| | |
|---|---|
| ***B67D 9/00*** | (2010.01) |
| ***B63B 27/24*** | (2006.01) |
| ***B67D 9/02*** | (2010.01) |
| ***B63B 27/25*** | (2006.01) |
| ***B63B 27/34*** | (2006.01) |

(52) U.S. Cl.
CPC ..... *B67D 9/00* (2013.01); *B63B 27/24* (2013.01); *B63B 27/25* (2013.01); *B63B 27/34* (2013.01); *B67D 9/02* (2013.01); *Y10T 137/8807* (2015.04)

(58) Field of Classification Search
CPC .. B67D 9/00; B67D 9/02; B63B 27/24; Y10T 137/8807
See application file for complete search history.

(56) References Cited

U.S. PATENT DOCUMENTS

| | | | | |
|---|---|---|---|---|
| 2,818,891 | A | 1/1958 | Loeser | |
| 8,118,632 | B2 * | 2/2012 | De Baan et al. | B63B 27/24 114/230.12 |
| 2005/0039802 | A1 * | 2/2005 | Baan | B63B 27/24 137/615 |

FOREIGN PATENT DOCUMENTS

| | | | |
|---|---|---|---|
| EP | 1389580 | A1 | 2/2004 |
| GB | 880699 | A | 10/1961 |
| GB | 1329887 | A | 9/1973 |
| WO | 2013064601 | A1 | 5/2013 |

OTHER PUBLICATIONS

PCT Patent Application PCT/GB2015/051305 International Search Report and Written Opinion dated Jun. 24, 2015.

* cited by examiner

*Primary Examiner* — Kevin Lee
(74) *Attorney, Agent, or Firm* — Erise IP, P.A.

(57) ABSTRACT

A fluid transfer apparatus for transferring fluids such as hydrocarbon fuel is disclosed. The fluid transfer apparatus comprises a support member and at least one catenary hose, wherein a proximal end of each catenary hose is suspended from the support member. A distal end of each catenary hose is coupled to a transfer manifold. A tensioning member is arranged for applying a tensile force to the transfer manifold during a transfer operation.

15 Claims, 6 Drawing Sheets

FLUID TRANSFER APPARATUS

RELATED APPLICATIONS

The present application is a national stage application under 35 U.S.C. § 371 of International Application No. PCT/GB2015/051305, filed 1 May 2015, and which claims priority from GB Application No. 1407827.3, filed 2 May 2014. The above-referenced applications are hereby incorporated by reference into the present application in their entirety.

FIELD OF THE INVENTION

The present invention relates to a fluid transfer apparatus. In particular, but not exclusively, the present invention relates to a transfer apparatus for transferring liquids or gases such as hydrocarbon fuels, such as liquid natural gas (LNG), between bodies in relative motion. The present invention finds particular utility in a marine environment.

BACKGROUND TO THE INVENTION

In many environments it is required to transfer fluid between bodies in relative motion to one another. For example, in a marine environment, fluids such as hydrocarbon fuels are often loaded onto ships. In such an environment the floating ship operates with a degree of movement which must be accommodated.

These issues occur when a ship is supplied from the shore and also when ships are supplied by other floating vessels. For example, a bunker vessel may be used to refuel a larger ship. In recent years, the use of liquid natural gas (LNG) as a fuel for maritime vessels has increased in popularity meaning that the provision of a bunker vessel able to refuel an LNG-fuelled ship is increasingly desirable, in addition to the need to transfer LNG between vessels.

Many prior art transfer techniques utilise articulated arms comprising a plurality of rigid sections pivotally mounted to one another to allow for degrees of movement. While this approach has resulted in reliable and robust transfer arms, there remain difficulties with the practical implementation of such systems in a range of circumstances.

For example, there are substantial challenges in developing transfer arms comprising rigid members which have a sufficient range of movement. The range of movement required increases in particular when the transfer occurs between two floating vessels. Moreover, to provide appropriate degrees of movement at each joint in the articulated arm, the pipe through which the fluid is transferred is often disposed at a central axial point. This means that in many designs the arm can only carry a single pipe, or that incorporating an additional line results in significantly increased complexity. This is a particular disadvantage in the transfer of liquid natural gas, since it is often necessary not only to transfer LNG to the receiving vessel but to carry boil off gas (i.e. LNG vapour) away from that vessel. There are difficulties in providing the vapour line in rigid arm solutions.

In addition to the above, transfer apparatuses of the type described above can be difficult to maintain and awkward to manoeuvre. In particular, rigid arm solutions are typically heavy with each arm generally balanced around their pivot by counter weight. The outcome of this arrangement is that large forces can be generated at the receiving vessel manifold when the relative motion increases in amplitude or speed.

In response to the difficulties outlined above, solutions have been proposed which use flexible hoses to transfer the fluid. The flexibility of the hoses is able to accommodate some of the relative movement that occurs due to the floating vessel or vessels. However, it is not appropriate merely to allow hoses to be extended between the receiving vessel and the source in an uncontrolled manner. Control is required when managing the connection and disconnection of the apparatus, but is also beneficial during any fluid transfer. One particular requirement when delivering fuel is that it is necessary to have a mechanism to handle emergency disconnection in an unexpected situation. For example, it is necessary to provide a mechanism to move the hose to a safe location should such a disconnection occur.

One proposed solution is described in International Patent Application No. WO2013/064601. This document describes a fluid transfer hose manipulator in which the hose is supported by an articulated arm which both maintains the hose in position and maintains it under tension. In this way, a structure is provided for the flexible hose. The structure comprises a plurality of hose guides at each of the connecting points in the articulated arm to ensure that the hose follows the structure of the arm. The articulated arm also comprises a hose tensioner which ensures that the hose is maintained under tension at all times.

While this approach provides some flexibility, it is dependent upon the reliability of the hose. The hose is under tension and is repeatedly flexed as relative motion occurs It is therefore necessary to ensure that any hose used is capable of withstanding such usage and to provide appropriate maintenance, perhaps repeatedly replacing the hose over the lifetime of the apparatus. This increases the complexity and expense of the solution. The issues involved are particular complex when the fluid carried is LNG, since this is carried at low temperatures (typically around −163° C.) and thus placing its own limits on hose materials and design.

There is therefore a continuing desire to provide a transfer apparatus which provides advantages in both reliability and flexibility. At the same time, it is important that any apparatus complies with the stringent safety requirements for the transfer of flammable fluids, particularly at sea, by providing suitable control.

SUMMARY OF THE INVENTION

According to an aspect of the present invention, there is provided a fluid transfer apparatus, comprising a support member;

at least one catenary hose having a proximal end suspended from the support member;

a transfer manifold coupled to a distal end of the or each catenary hose a tensioning member for applying a tensile force to the transfer manifold during a transfer operation.

The apparatus of the present invention can assist in providing both flexibility and control to a fluid transfer operation. In particular, the catenary hose can flex to accommodate relative motion between the apparatus and the counter-party to which the apparatus is attached, while control is provided by the extensible tensioning member which can act to maintain suitable control over the distal end of the catenary hose. Accordingly, the hose itself need not be under tension. This is found to increase the reliability of suitable hoses for fluid transfer, particular when repeated flex of the hose is incurred.

The tensile force provided in the tensioning member provides particular advantages in an emergency disconnection scenario. Rather than allowing the manifold to fall away from the receiving vessel in an uncontrolled manner, the tensioning member provides a sufficient tensile force such that the transfer manifold is moved in a predefined direction. Preferably, the tensioning member provides a sufficient tensile force to lift the transfer manifold upwards if a disconnection with the receiving vessel occurs. By maintaining a tensile force of at least this magnitude throughout the transfer operation, at no time is there a risk of uncontrolled disconnection.

Preferably, the tensioning member is extensible. That is to say, the tensioning member may vary in length, both increasing and decreasing as desired. More preferably, the tensioning member is flexible. This means that flex in the catenary hose can be at least partly accommodated by extending and/or flexing the tensioning member. A tension drive mechanism may be provided to maintain tension in the tensioning member during the transfer operation. The tension drive member may be a tension winch or a hydraulic drive system, for example. The tensioning member is preferably maintained under constant tension during the transfer operation. For example, the tension drive member may be designed to maintain constant tension in the tensioning member during the transfer operation.

In preferred embodiments, the apparatus further comprises a tension support arm from which the tensile member is suspended. Alternatively, the tensile member may be suspended from the support member. The tensile support arm may comprise a plurality of rigid elements movable relative to one another. Movement of the tensile support member may be controllable, for example by a hydraulic system. As such, the tensile support member may be moved to control the position of the tensioning member, which can increase the operating envelope of positions in which the tensioning member can support the transfer manifold coupled to the distal end of the catenary hose.

In some preferred embodiments, a suspended hose may be coupled between the catenary hose and the transfer manifold and a restraining member which prevents tension being applied to the suspended hose. This may provide further flexibility. For example, the suspended hose may be suspended from the tensioning member, enabling the transfer manifold to be provided at a distance to the tensioning member. The tensile force applied to the transfer manifold by the tensioning member can be transmitted through the restraining member, for example.

Preferably, the support member further comprises one or more rigid pipes coupled to the or each catenary hose. This allows fluid to be carried to the or each catenary hose through a rigid and reliable connection.

Preferably, the apparatus further comprises a pedestal, and the support member is pivotally mounted to the pedestal. The tensile support arm may also be pivotally mounted to the pedestal. Preferably, the coupling of the support member and/or the support arm to the pedestal allows rotational movement around a substantially vertical axis. The pedestal movement may thus provide rotational movement in a horizontal plane, while the suspended tensioning member may provide movement along a vertical axis.

Preferably, the transfer manifold further comprises an emergency release system for preventing transfer of fluid in an emergency. The emergency release system may be hydraulically powered. In preferred embodiments, the emergency release system comprises a double isolation valve, such as a double ball valve.

Preferably, the fluid is a hydrocarbon fuel, more preferably liquid natural gas (LNG). In particular embodiments, there may be provided two catenary hoses. These may carry LNG to a receiving system and receive boil off gas (i.e. LNG which has evaporated) from the receiving system.

According to a further aspect of the present invention, there may be provided a bunker vessel comprising the apparatus of the previous aspect. A bunker vessel is a vessel designed to provide fuel to another vessel. As both vessels may be floating during the fuel transfer, it is important to provide adequate flexibility in the transfer apparatus, and as such the transfer apparatus of the present invention finds particular utility.

BRIEF DESCRIPTION OF THE DRAWINGS

Embodiments of the present invention will now be described with reference to the accompanying drawings, in which.

DETAILED DESCRIPTION

Figure 1:
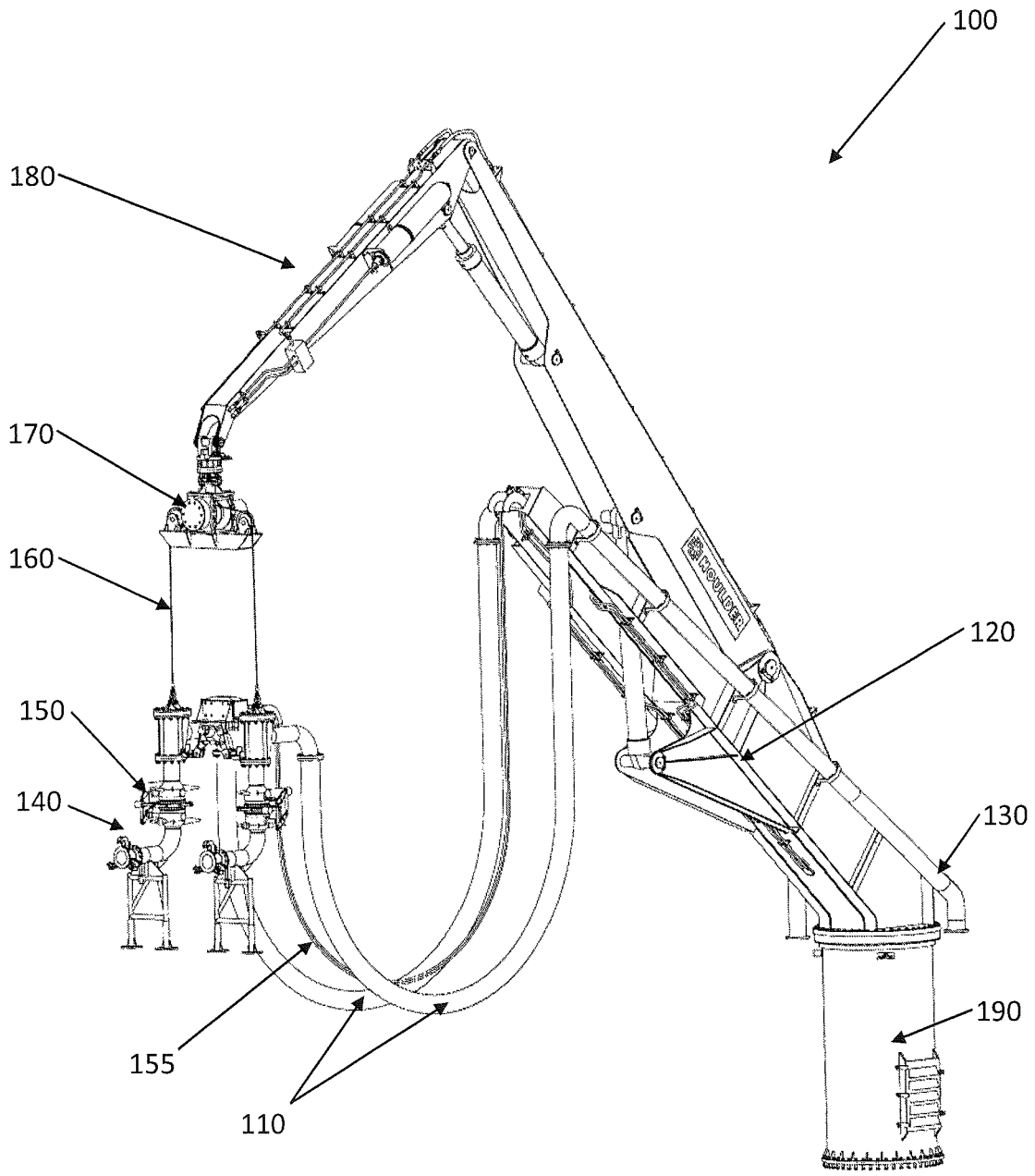
FIG. 1 is a perspective view of a fluid transfer apparatus according a first preferred embodiment of the present invention.

Referring to FIG. 1, a perspective view of a fluid transfer apparatus 100 is shown. The fluid transfer apparatus 100 is designed to provide fluid, particular liquid natural gas (LNG) to a receiving vessel and to receive boil-off gas (LNG vapour) therefrom. The fluid transfer apparatus 100 is designed to accommodate movement of the receiving vessel.

The fluid transfer apparatus comprising two catenary hoses 110 each suspended from a support member 120 at a proximal end. The support member 120 comprises two sections of rigid pipe 130, each coupled to the proximal end of one of the catenary hoses 110. The rigid pipe 130 may be coupled to a bunker vessel gas system (not shown) or other source of fluid for transfer.

The distal end of each catenary hose 110 is coupled to a transfer manifold 140. The transfer manifold 140 can be coupled to the systems of a receiving vessel. As such, the apparatus 100 may transfer fluid to and from a receiving vessel through a path comprising the rigid pipe 130, the catenary hose 110 and the transfer manifold 140. The apparatus 100 allows the position of the transfer manifold 140 to move through an operating envelope in order to accommodate the relative movement of the receiving vessel.

The transfer manifold 140 comprises an emergency release system 150, which is hydraulically powered via a hydraulic supply line 155, which is suspended from the support member 120. The emergency release system comprises a double isolation valve, particularly a double ball valve for each fluid path which is activated to prevent transfer of fluid in the case of an emergency.

A tensioning member 160 is also provided. The tensioning member 160 comprises two wire elements which are maintained under constant tension by a constant tension winch 170. In the embodiment show, the tensioning member 160 is coupled to the transfer manifold 140, and exerts a tensile force on the distal end of each catenary hose 110 via the manifold 140. The tensioning member 160 is extensible, in the sense that its longitudinal extent may vary. In the preferred embodiment shown in FIG. 1, this is achieved through the constant tension winch which releases more or less wire according to the current level of tension.

The tensioning member 160 is suspended from a support arm 180 comprising a plurality of rigid elements which are movable relative to one another and are hydraulically controlled. The movable elements are pivotally mounted to each other. In the preferred embodiment, the pivotal mounting of the rigid elements is around a horizontal axis, although other axes or forms of movement are possible. By controlling the support arm 180, the position of the tensioning member 160 and thus the transfer manifold 140 can be controlled.

The support member 120 and the support arm 180 are pivotally mounted to a pedestal 190. The pedestal enables rotational movement of the support member 120 and support arm 180 around a vertical axis.

In use, the apparatus 100 is brought to the vicinity of a receiving vessel. During a connection stage, the tension winch 170 may be configured to maintain a constant length of the tensioning member (rather than a constant tension) in order for the position of the transfer manifold 140 to be readily maneuvered towards a receiving manifold of the receiving vessel. The support arm 180 may be used to move the transfer manifold 140 close to the receiving manifold of the receiving vessel. An automatic or manual procedure can be followed to secure the transfer manifold 140 to the receiving manifold. A guidance system may be provided to facilitate this operation. The tension winch may then be controlled to enter a mode in which tension in the tensioning member 160 is kept constant.

Once the transfer manifold is secured to the receiving manifold of the receiving vessel, transfer operations can begin. For example, LNG can be transferred to the receiving vessel through one of the catenary hoses while boil-off gas can be received through the other. If the receiving vessel moves during the transfer operation, this is accommodated by flexibility in the transfer apparatus 100. In particular, the catenary hoses 110 provide flexible fluid paths that can accommodate relative movement. Moreover, while the transfer manifold 140 is also coupled to the tensioning member 160, the extensible nature of the tensioning member 140 enables movement of the transfer manifold 140 as does the movable support arm 180 from which the tensioning member 160 is supported.

During the transfer of fluid, the tensioning member 160 applies a tensile force to the transfer manifold 140. In the preferred embodiment, the tensile force is constant throughout the transfer operation, although it may be variable in alternative embodiment. As a result, if the transfer manifold should become disengaged from the receiving manifold of the receiving vessel then the tensioning member 160 will act to pull the transfer manifold away, preferably upwards, from its current location. Accordingly, in the case of an unexpected disengagement, the transfer manifold 140 will automatically move away from the receiving vessel. This fulfils a safety requirement during fuel transfer.

In addition, in the case of an unexpected disengagement, the emergency release system 150 will act to prevent the transfer of fluid through the transfer manifold 140. In particular, the double ball valve of the emergency release system is engaged using power from hydraulic supply line 155 to close the fluid path through the transfer manifold.

Figure 2:
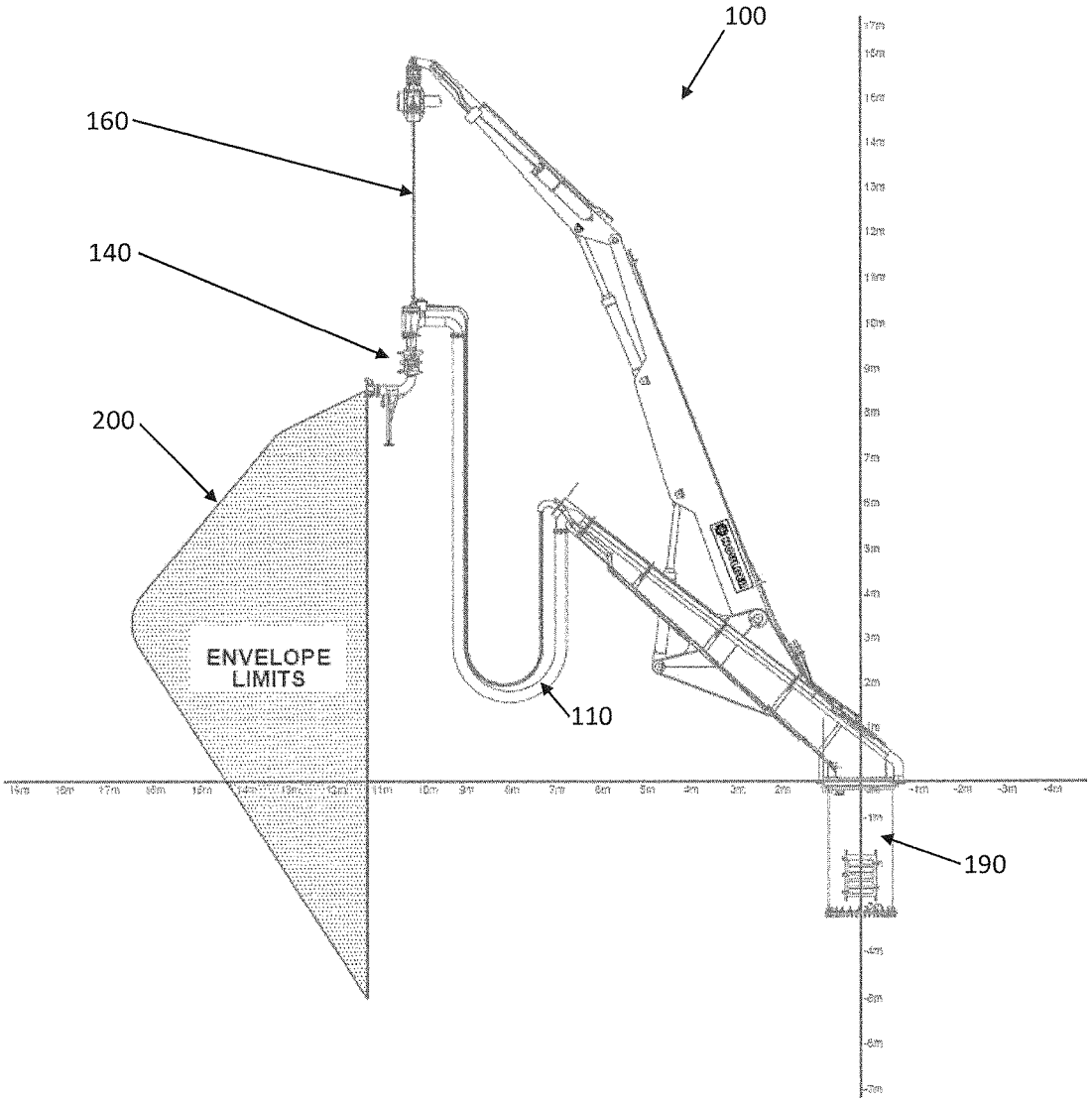
FIG. 2 is a side view of the first preferred embodiment, showing the operating envelope in a vertical plane.
Figure 3:
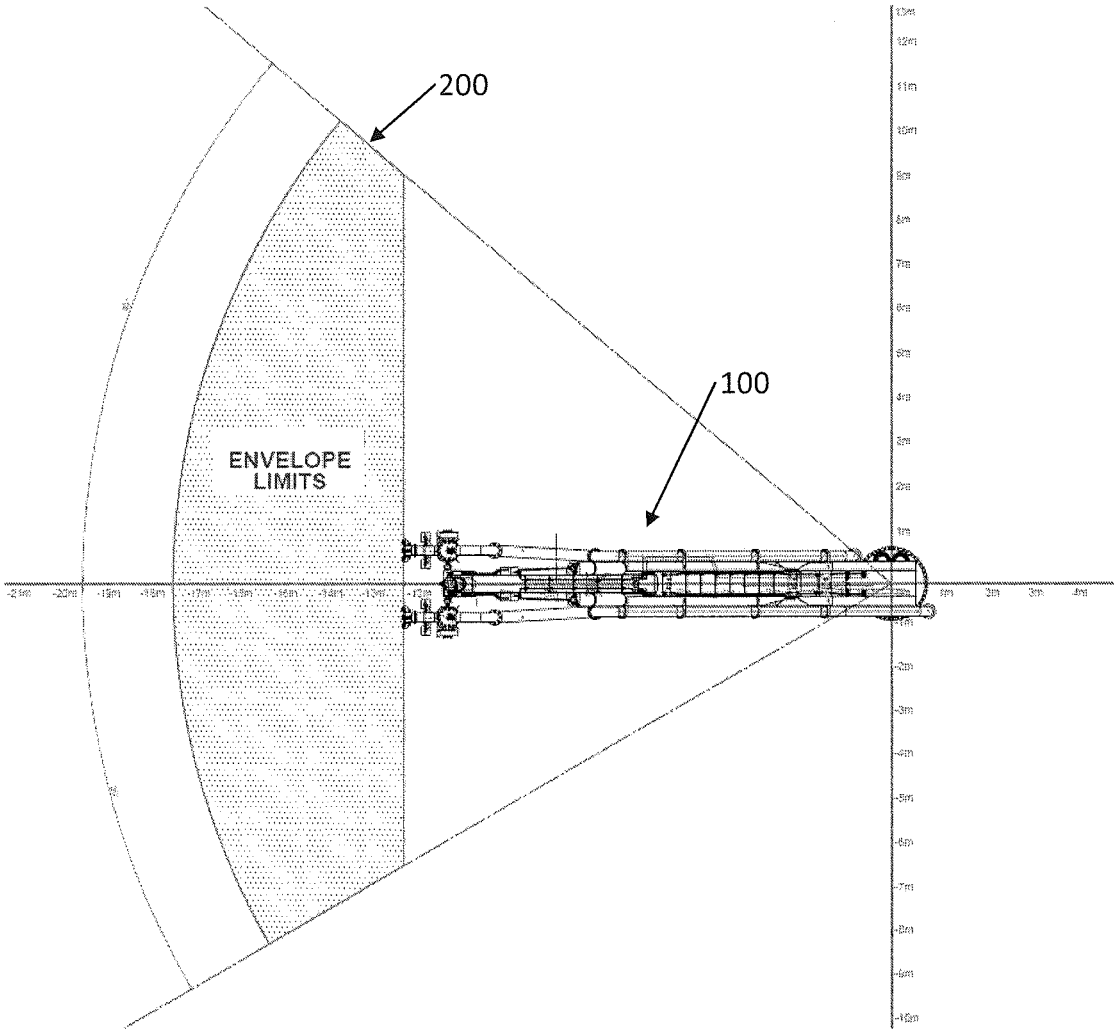
FIG. 3 is a top down view of the first preferred embodiment, showing the operating envelope in a horizontal plane.

The range of movement of the transfer manifold 140 during a transfer operation can be understood with respect to FIGS. 2 and 3, which show side and top-down views of the apparatus 100 respectively. Also illustrated in FIGS. 2 and 3, is an operating envelope 200 in which the transfer manifold 140 can safely move during a transfer operation. In FIG. 2, the range of movement in a vertical plane is shown. This movement can be accommodated through movement of the support arm 180, flexibility of the tensioning member 160 and flexibility of the catenary hoses 110. In FIG. 3, the range of movement in a horizontal plane is illustrated; the pivotal mounting of the support arm 180 and support member 120 to the pedestal 190 enables movement around an axis in this plane.

The range of movement of the transfer manifold 140 may be monitored against the prescribed envelope or the given hose length to engage automatic disconnection before the system exceeds its limit.

Figure 4:
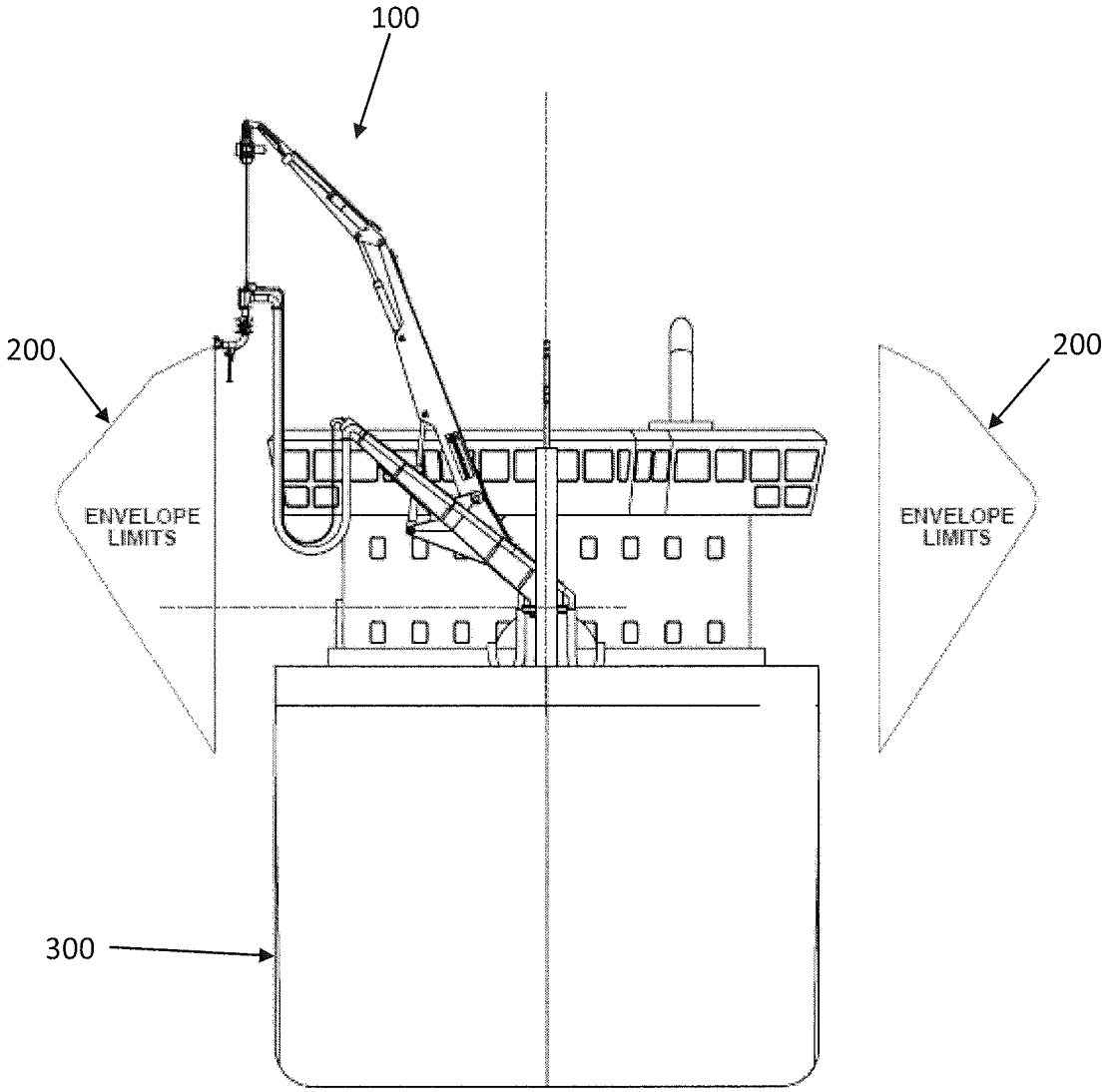
FIG. 4 illustrates a bunker vessel comprising the fluid transfer apparatus of the first preferred embodiment.

FIG. 4 illustrates a bunker vessel 300 on which the apparatus 100 is mounted. The bunker vessel 300 can be used to re-fuel other vessels at sea. The apparatus finds particular utility in this environment as relative motion of the two vessels may be significant.

Figure 5:
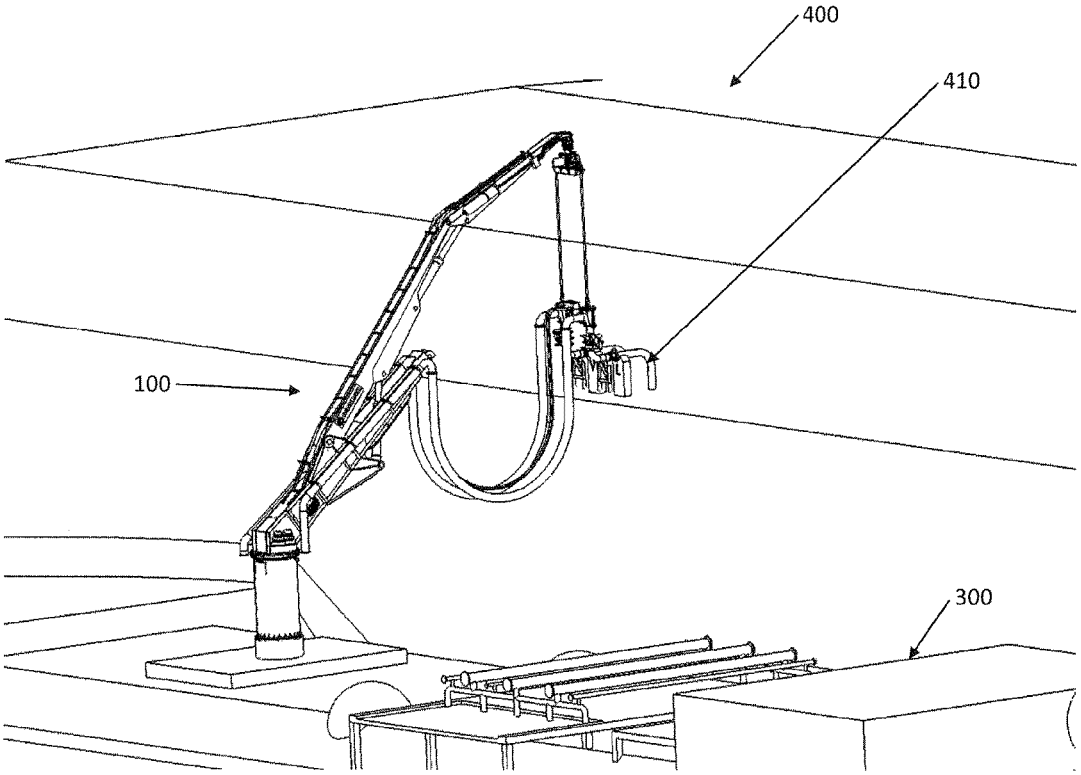
FIG. 5 illustrates the transfer apparatus of the first preferred embodiment during a transfer operation.

FIG. 5 illustrates the transfer apparatus 100 in place during a transfer operation. The transfer apparatus is mounted upon the bunker vessel 300 which is positioned adjacent to a receiving vessel 400. The transfer manifold 140 is connected to a receiving manifold 410 of the receiving vessel 400. The transfer manifold 140 is designed such that in use (i.e. during the transfer operation when the transfer manifold 140 is coupled to the receiving manifold 410) the isolation valve 150 is located outside the lateral extent of the hull of the receiving vessel 400.

Figure 6:
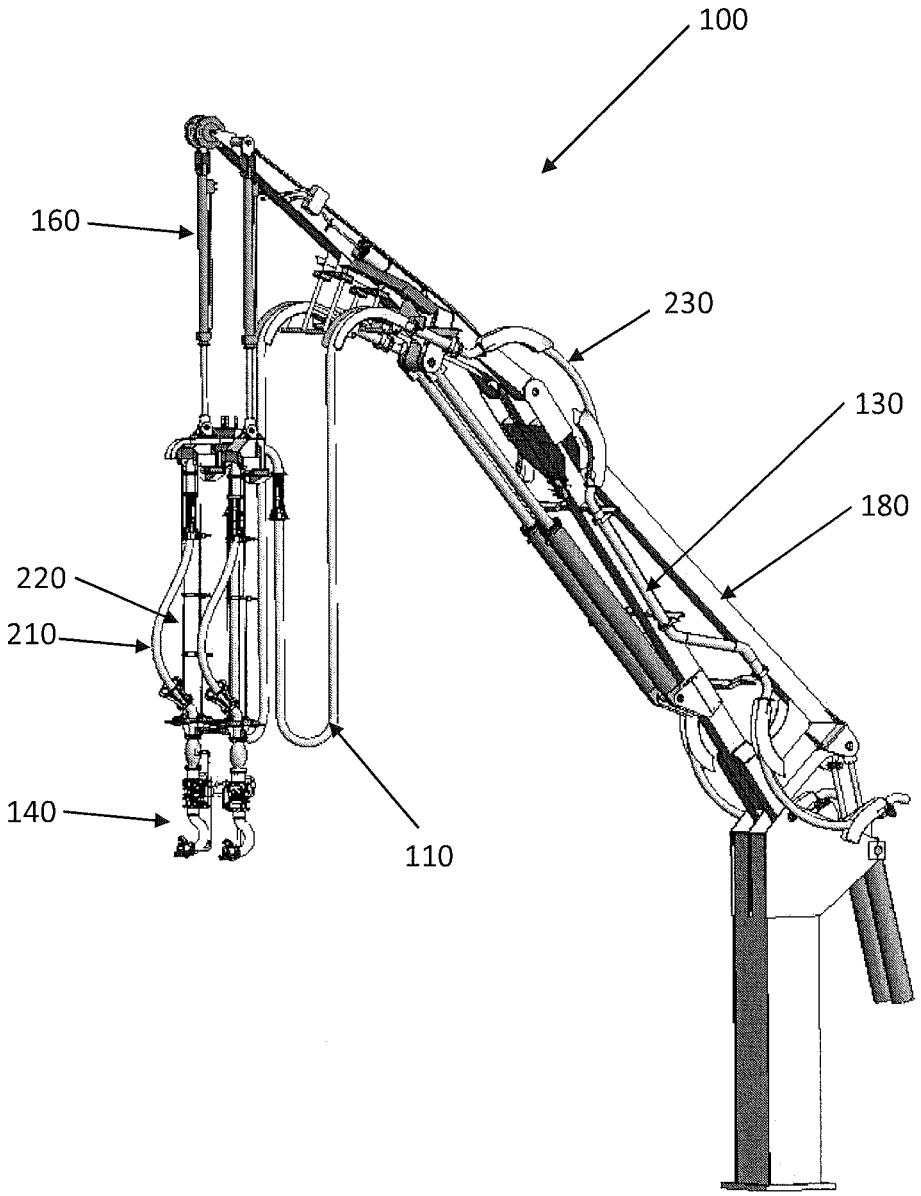
FIG. 6 illustrates a fluid transfer apparatus according to a second preferred embodiment of the present invention.

FIG. 6 illustrates a perspective view of a second preferred embodiment of the present invention. Like features are represented by like reference numerals as compared to FIGS. 1 to 4 illustrating the first preferred embodiment.

The second preferred embodiment comprising an alternative tensioning member 160. In the second preferred embodiment, the tensioning member 160 comprises one or more hydraulic cylinders which are controlled by a hydraulic control mechanism (not shown). The hydraulic cylinders are extensible but are not otherwise flexible, and in order to allow for greater flexibility, the tensioning member is coupled to the transfer manifold 140 via one or more suspended hoses 210. In order to avoid the suspended hoses 210 coming under tension, a flexible restraining member 220 is provided which prevents over-extension of the suspended hoses 210. As shown in FIG. 6, the suspended hoses are deliberately bowed into a predefined shape prior to operation. This means that if the hose extends during operation (e.g. through the application of pressure) or retracts afterwards the manner in which this occurs is controlled so that no tension is applied to the hose and no bends in the hose occur which are under a minimum prescribed bending radius.

In the second preferred embodiment, the support arm 180 is integrated with the support member 120. In order to ensure a fluid path through articulated points in the support arm 180, hose jumpers 230 are provided at such points to connect sections of rigid pipe 130.

Other variations and modifications will be apparent to the skilled person. Such variations and modifications may involve equivalent and other features which are already known and which may be used instead of, or in addition to, features described herein. Features that are described in the context of separate embodiments may be provided in combination in a single embodiment. Conversely, features which are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present disclosure.

The invention claimed is:

1. A fluid transfer apparatus, comprising a support;

at least one catenary hose having a proximal end suspended from the support member;

a transfer manifold coupled to a distal end of the or each catenary hose;

a tensioning member for applying a tensile force to the transfer manifold during a transfer operation; and a suspended hose coupled between the catenary hose and the transfer manifold.

2. The apparatus of claim 1, wherein the tensioning member is extensible.

3. The apparatus of claim 2, further comprising a tension drive mechanism arranged to maintain tension in the tensioning member during the transfer operation.

4. The apparatus of claim 3, wherein the tension drive mechanism is arranged to maintain a constant tension in the tensioning member during the transfer operation.

5. The apparatus of claim 1, further comprising a support arm from which the tensioning member is suspended.

6. The apparatus of claim 5, wherein the support arm comprises a plurality of rigid elements movable relative to one another.

7. The apparatus of claim 1, further comprising a restraining member which prevents tension being applied to the suspended hose.

8. The apparatus of claim 1, wherein the support further comprises one or more rigid pipes coupled to the or each catenary hose.

9. The apparatus of claim 1, further comprising a pedestal, wherein the support is pivotally mounted to the pedestal.

10. The apparatus of claim 1, wherein the transfer manifold further comprises an emergency release system for preventing transfer of fluid in an emergency.

11. The apparatus of claim 10, wherein the emergency release system comprises a double isolation valve.

12. The apparatus of claim 1, wherein the fluid is a hydrocarbon fuel.

13. The apparatus of claim 12, wherein the fluid is liquid natural gas.

14. The apparatus of claim 1, comprising at least two catenary hoses.

15. The apparatus of claim 1, wherein the apparatus is housed in a bunker vessel.

* * * * *